United States Patent [19]

Hornung et al.

[11] Patent Number: 5,025,549

[45] Date of Patent: Jun. 25, 1991

[54] LEAD MAKING MACHINE HAVING IMPROVED WIRE FEEDING SYSTEM

[75] Inventors: Craig W. Hornung, Harrisburg; Alden O. Long, Carlisle, both of Pa.

[73] Assignee: AMP Incorporated, Harrisburg, Pa.

[21] Appl. No.: 576,309

[22] Filed: Aug. 31, 1990

[51] Int. Cl.[5] ..... H01R 43/052; H01R 43/05

[52] U.S. Cl. ..... 29/564.4; 29/753; 29/867; 81/9.51

[58] Field of Search ..... 29/33 M, 564.2, 564.4, 29/564.6, 564.8, 748, 753, 857, 867; 81/9.51

[56] References Cited

U.S. PATENT DOCUMENTS

| | | | |
|---|---|---|---|
| 2,954,599 | 10/1960 | Cootes et al. | 29/33 |
| 3,019,679 | 2/1962 | Schwalm et al. | 81/9.51 |
| 3,030,694 | 4/1962 | Kerstetter et al. | 29/33 |
| 3,612,369 | 10/1971 | Grebe et al. | 226/24 |
| 3,800,389 | 4/1974 | Brehm et al. | 29/203 D |
| 3,872,584 | 3/1975 | Chick et al. | 29/564.4 X |
| 4,554,725 | 11/1985 | Over et al. | 29/564.4 |
| 4,713,880 | 12/1987 | Dusel et al. | 29/564.4 |

*Primary Examiner*—Steven C. Bishop

[57] ABSTRACT

In-line lead making machine (30) has a wire transferring mechanism (18) for shifting the leading end of the wire (11), which extends from a barrel or other endless source (12), from the vicinity of the cutting and stripping blades (21) to a terminating machine (28). The wire (11) is then shifted back to the vicinity of the cutting and stripping blades (21) and fed from the source (12). The wire is then cut to produce the electrical lead (2). During shifting of the wire (11) from the terminating machine (28) to the vicinity of the cutting and stripping blades (21), the transfer mechanism (18) is pivoted upwardly and the wire feeding operation is started during shifting of the transfer mechanism. The wire (11) is thus fed over and above the severing and insulation cutting blades (21) rather than between these blades and the feeding step is started earlier in the cycle than would otherwise be possible.

16 Claims, 10 Drawing Sheets

LEAD MAKING MACHINE HAVING IMPROVED WIRE FEEDING SYSTEM

FIELD OF THE INVENTION

This invention relates to lead making machines and particularly to improved wire feeding systems for in-line lead making machines.

BACKGROUND OF THE INVENTION

A widely used type of lead making machine, referred to as an in-line machine, comprises a wire feeding means for feeding wire along a horizontal straight feed path which extends through upstream (relative to the direction of wire feed) and downstream transfer mechanisms and through wire severing blades and insulation cutting blades which are located between the upstream and downstream wire transferring mechanisms. Crimping presses are located adjacent to the wire severing and insulation cutting blades on one side or on both sides of the feed path. In use, the wire is fed through the transferring mechanisms until the desired length for the lead extends from the severing blades beyond the downstream transferring mechanism. The wire severing and insulation cutting blades are then closed and the transferring mechanisms are moved axially away from the blades to strip insulation from the cut ends of the wire, which extends from the wire source, and the trailing end of the lead which extends through the downstream transferring mechanism. The transferring mechanisms are then shifted to present the stripped ends of the wire and lead to the crimping presses at which terminals are crimped onto the stripped ends. The transferring mechanisms are then returned to their aligned positions on the feed path. A completed lead is removed from the downstream transferring mechanism while the wire from the endless source extends from the upstream mechanism and has a terminal crimped onto its end. The process of feeding the wire, closing the cutting and severing blades, etc., is then repeated to produce the next lead in the series.

Machines of the general type described above are widely used and many different specific types are available. U.S. Pat. Nos. 2,954,599 and 3,030,694 show early versions of machines of this type. One type of machine which is still widely used is shown in U.S. Pat. No. 3,019,679 and a modern machine is described in U.S. Pat. No. 4,554,725. The foregoing U.S. Patents are incorporated into this description by reference. The invention which is described herein can be used on the machines shown in the above-identified U.S. Patents or it can be used on a type of machine which is briefly described below.

On some occasions, problems have been encountered in the wire feeding step in machines of the type described above as a result of the requirement that the leading end of the wire which extends from the source through the upstream transferring mechanism must be fed through the open wire severing and insulation cutting blades at the beginning of the operating cycle. This leading end of the wire will ordinarily have a terminal crimped thereon and additionally, wire sometimes has a memory retained from its being coiled on a spool or the like which causes it to assume a curvature at its end. On some occasions, it has been found that the terminal on the leading end of the wire may encounter one of the severing blades or one of the insulation cutting blades, even though these blades are spaced apart during the feeding cycle. If this happens, the machine must be stopped and corrective action taken. The possibility of misfeeding under such circumstances requires that lead making machines be designed in a manner which will minimize such misfeeds. In accordance with one aspect thereof, the present invention is directed to the achievement of an improved feeding system which completely avoids any possibility of misfeeding as a result of the wire moving against one of the wire severing or insulation cutting blades during feeding.

In-line lead making machines are capable of being operated at relatively high speeds, speeds of 60 cycles per minute being quite common, in which case a finished electrical lead having a terminal on each end is manufactured every second. During the one second cycle time, the wire must be fed, cut, stripped of the insulation on the leading end of the wire and the trailing end of the lead, shifted to the crimping press, and after a terminal has been crimped onto the ends, shifted back in preparation for the next cycle. It follows that only a brief interval, about 0.4 seconds or less, is available for feeding wire during each operating cycle if the cycle period is one second. Wire feeding rolls which rotate at relatively high speeds and are capable of feeding wire at relatively high rates have been developed for in-line lead making machines in order to permit manufacture of long leads when required. However, there are circumstances where it is necessary to reduce the speed of the entire machine for the reason that the wire required for the relatively long leads being manufactured cannot be fed during the feeding interval if the machine is operated at a high speed.

In accordance with a further aspect thereof, the invention is directed to the achievement of a wire feeding system which effectively increases the feeding interval which is available for feeding wire during each operating cycle of an in-line lead making machine. The lengthening of the feeding interval in turn results in an ability to produce longer leads and/or permits operation of the machine at a higher speed (i.e., greater number of cycles per hour) than would otherwise be practical.

THE INVENTION

One embodiment of a lead making machine in accordance with the invention comprises a wire feeding means for intermittently feeding wire, during a wire feeding interval, from an endless source along a horizontal wire feed path which extends through a wire transferring means and thence past a pair of open wire severing blades. The machine has a terminal applicator such as a crimping press located beside the feed path and proximate to the wire transferring means. The applicator is also proximate to the wire severing blades. The wire transferring means is shiftable between an aligned position and a terminating position, the transferring means extending parallel to the feed path when in its aligned position and being directed towards the terminal applicator when in its terminating position. The wire transferring means is in its aligned position at the beginning of an operating cycle with the leading end of the wire extending from the transferring means so that upon shifting of the transferring means to the terminating station, a terminal can be crimped or otherwise secured to the end of the wire. Upon subsequent shifting of the transferring means to its aligned position, the wire can be fed past the severing blades and along the feed path, and upon cutting the wire at the end of the feeding interval, an electrical lead is produced having a terminal on its leading end. The machine is characterized in that the wire severing blades extend horizontally and are normally in spaced apart open positions. The blades are movable horizontally relatively towards each other to their closed positions thereby to sever a wire located between the blades. The machine is further characterized in that means are provided for elevating the transferring means during an initial portion of the wire feeding interval whereby the leading end of the wire having a terminal thereon is fed over and above the severing blades along an arcuate trajectory, rather than along a straight path which extends between the blades. Preferably, the transferring means is elevated during a final portion of its shifting movement from its terminating position to its aligned position and the wire feeding means commences to feed wire during shifting of the transferring means so that the interval for feeding wire is lengthened.

THE DRAWING FIGURES

THE DISCLOSED EMBODIMENT

Figures 1, 2:
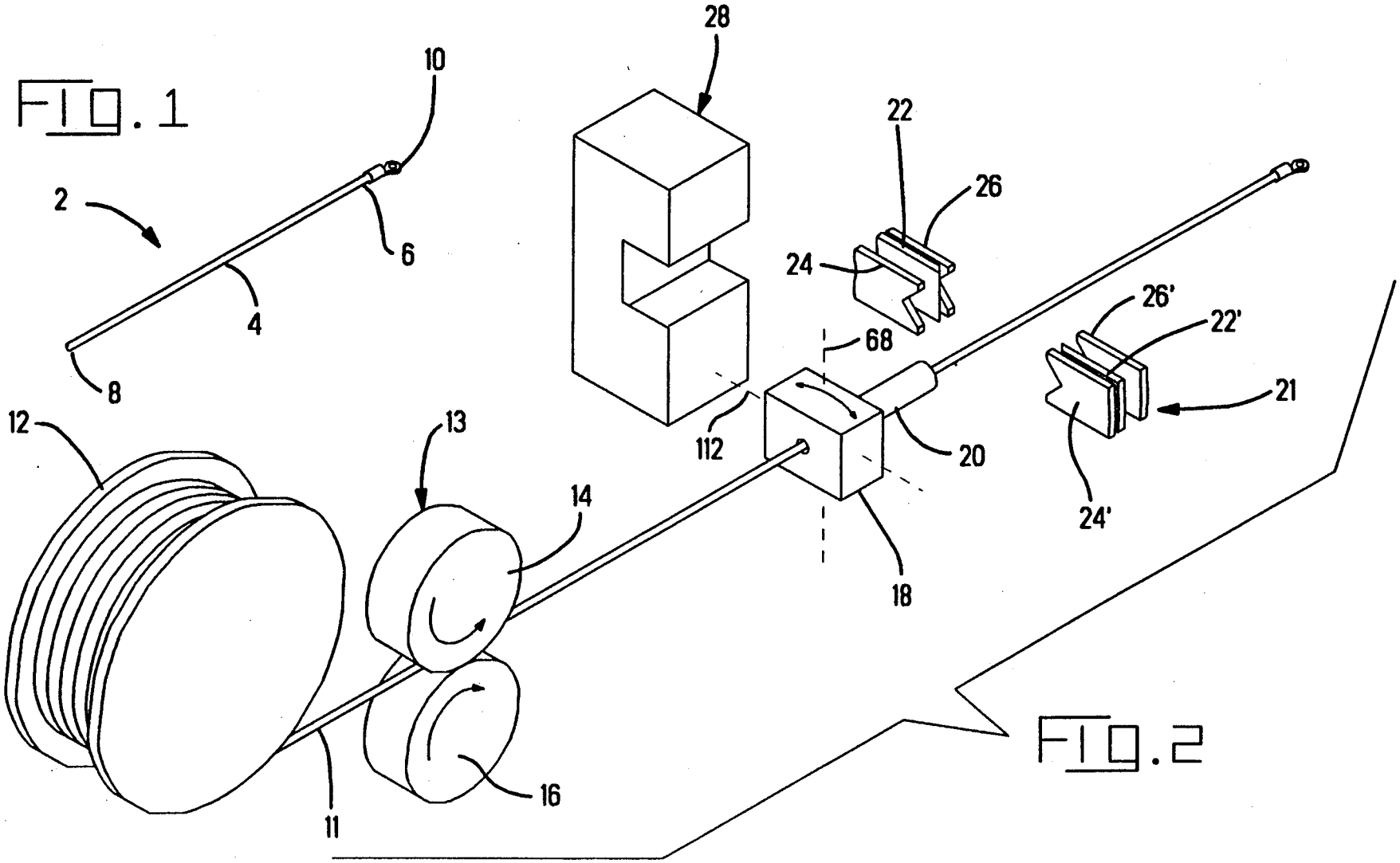
FIG. 1 shows an electrical lead produced by an embodiment of the invention described herein.
FIGS. 2–6 are a series of diagrammatic views which illustrate the practice of the invention and which show, diagrammatically, the essential parts of a machine for practicing the invention.

An electrical lead 2, FIG. 1, which is produced by the practice of the invention, comprises a lead wire 4 having a leading end 6 and a trailing end 8. A terminal 10 is crimped onto the leading end and a terminal can be provided on the trailing end if desired. The present invention is concerned only with the processing of the leading end and the trailing end processing is described only briefly below.

FIGS. 2–6 illustrate diagrammatically the practice of the invention and show only the essential parts of a machine for practicing the invention. FIG. 2 shows the positions of the wire and the machine parts at the beginning of an operating cycle. The machine parts comprise a wire feeding means 13 comprising rolls 14, 16, a transferring mechanism 18, a wire severing and insulation stripping assembly 21, and a crimping machine or similar terminal applicator 28. The wire 11 for the process is fed from an endless source such as a spool 12 by the feed rolls 14, 16 along a horizontal feed path which extends through the transferring mechanism and emerges from a nozzle or guide tube 20 on the transfer mechanism. In FIG. 2, the wire is shown as extending between the horizontal wire severing blades 22, 22' and the upstream and downstream insulation cutting blades 24, 24', 26, 26' which are in their open positions. The wire shown in FIG. 2 was fed during the previous operating cycle. The complete operating cycle is as follows.

Figure 3:
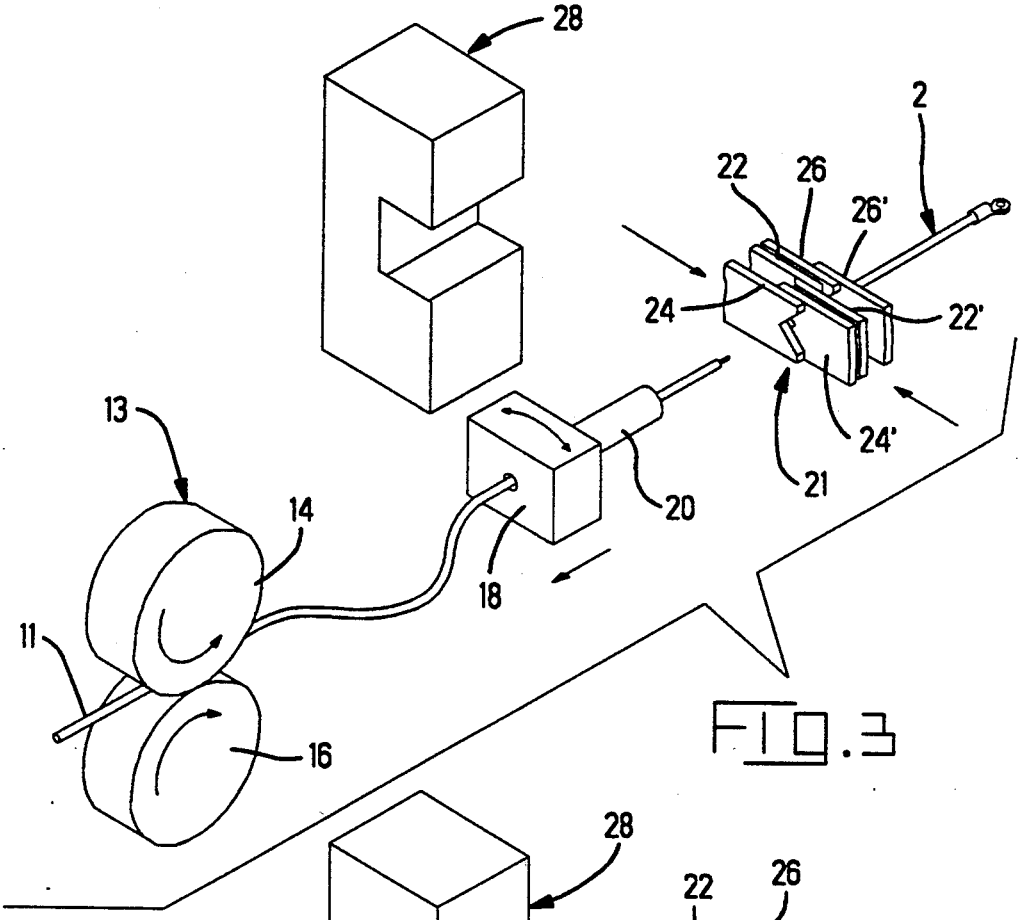
Figure 4:
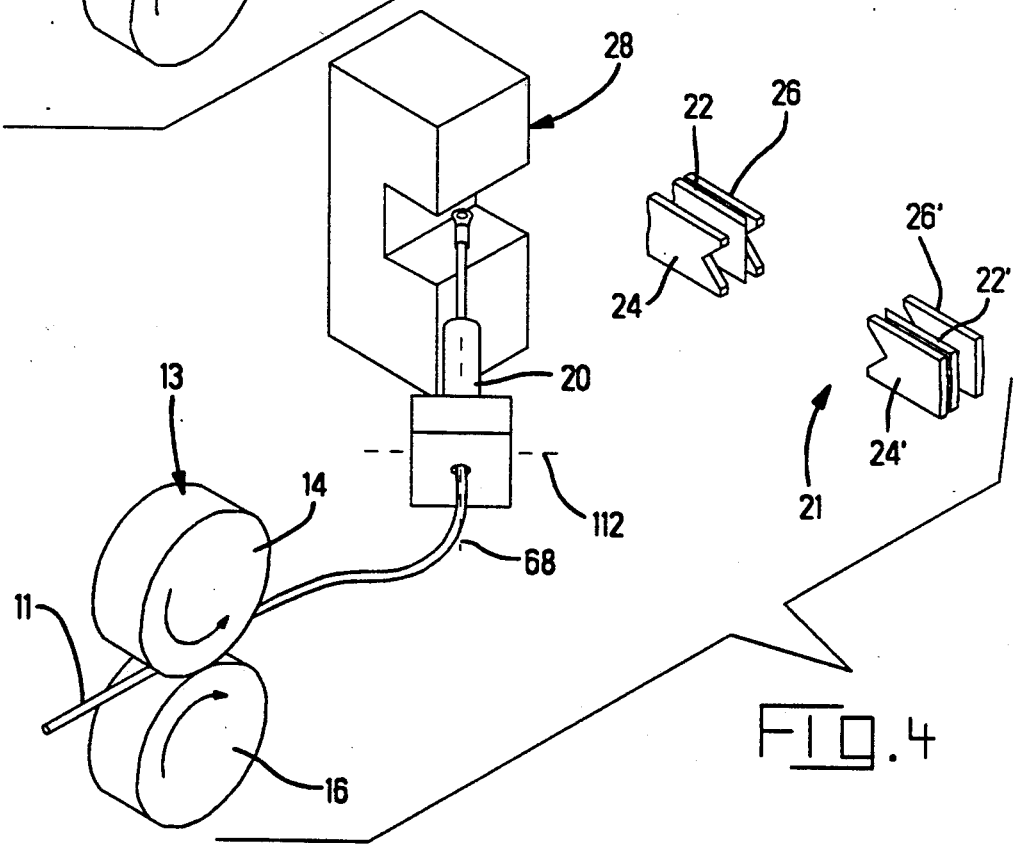
Figure 5:
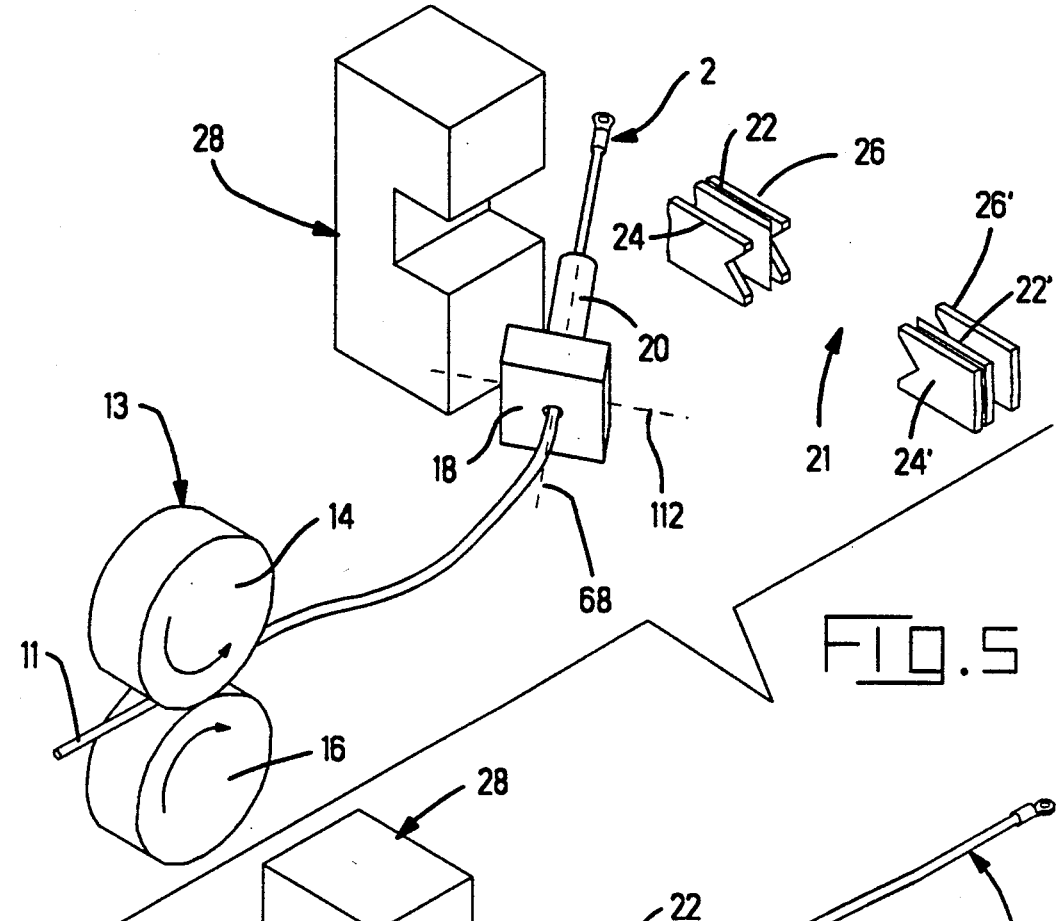

The wire severing blades 22, 22' and insulation cutting blades 24, 24', 26, 26' are first moved horizontally towards each other to their closed positions to sever the lead 2 from the end of the wire 11 and circumferentially to cut the insulation on the leading end of the wire 11 and on the trailing end of the lead. The wire is then clamped in the transfer mechanism 18 and the mechanism is moved axially in an upstream (relative to the direction of wire feed) direction as shown in FIG. 3 thereby to pull the wire from between the closed insulation cutting blades 24, 24' and strip the insulation from the leading end of the wire 11. The transfer mechanism 18 is then swung or shifted, FIG. 4, about a vertical axis 68 to present the stripped end of the wire to the terminating machine 28 at which a terminal 10 is crimped or otherwise secured to the wire. Thereafter, the transfer mechanism is shifted back to its aligned position; however, it is not shifted in a horizontal plane but is rather moved along an upward path while it is being swung or shifted to its aligned position. During such upward movement along with the shifting movement, wire feeding is commenced by rotating the feed rolls 14, 16 so that the wire is actually fed during the shifting process. When the transfer mechanism arrives back at its aligned position, FIG. 6, the transfer mechanism has been swung upwardly about a horizontal axis 112 so that the wire is fed above, and over, the horizontal wire severing and insulation cutting blades. The transfer mechanism 18 is then rotated about the horizontal axis 112 downwardly to the position of FIG. 1. Such downward movement of the transfer mechanism and the nozzle 20 locates the wire between the wire severing and insulation cutting blades which were opened previously.

Two distinct advantages are achieved in the practice of the invention. By virtue of the fact that the wire is fed along a trajectory which is above the wire severing and insulation cutting blades, there is no possibility that during feeding, the wire or the terminal on the end of the wire will encounter any of the blades in the wire severing and insulation cutting assembly 21 thereby causing the machine to become jammed and to require servicing. A second advantage results from the fact that wire feeding can be started while the transfer mechanism 18 is being shifted from its terminating position to its aligned position. The wire feeding interval, which is available for feeding wire, is lengthened by a significant amount since wire feeding need not be delayed until the transfer mechanism is in its aligned position. By virtue of the fact that the available feeding interval is lengthened, it is possible to operate the machine at a higher speed and/or, produce longer leads than would be the case if it were necessary to delay feeding until the transfer mechanism reached its aligned position. The term "speed" as used above refers to the number of operating cycles of the machine in a given time period; e.g., a speed of 3600 cycles per hour results in the production of 3600 leads per hour.

FIGS. 7–10 show a typical in-line lead making machine 30 for the practice of the invention. The machine has a frame assembly having a top plate 32 on which the feeding assembly 13, the transferring means 18, and the other machine elements noted above are supported. The wire feed assembly comprises the previously identified feed rolls 14, 16 which are supported in a frame assembly 34. At least one of the rolls is driven by a stepping motor 36 which is under the control of a micro-processor or the like. The other roll may also be driven by a belt coupled to the driven roll if desired. It is preferable to provide encoding rolls 37 upstream from the feed rolls 14, 16 in order to record the actual length of wire fed during an operating cycle. The wire extends from the spool 12 through the encoding rolls thence through an upstream wire guide 38 which extends into the nip of the rolls. The wire 11 emerges from a downstream wire guide 40 which in turn is coupled to a flexible tube 62 which guides the wire to the outlet nozzle 20.

The wire transferring means 18 for transferring the wire to the terminal applicator comprises a lever assembly 42 having a downstream end 44 which is adjacent to the cutting and stripping assembly, and an upstream end 46 which is proximate to the feed rolls. The lever assembly 42 comprises two parallel rods 48, FIG. 9, which are slidably supported in a central support block 50. A downstream mounting block 52 is secured to the downstream ends of the rods 48 and a cylinder 56 is fixed to this downstream block. A spacer is provided above the cylinder and a nozzle body 54 is in turn mounted on the spacer. The nozzle 20 extends from this nozzle body which has a passageway extending therethrough for the wire.

It is necessary to clamp the wire in the nozzle body for a portion of the cycle during which the transfer mechanism is moved in an upstream direction to strip insulation from the end of the wire and it is preferable to hold the wire in a clamped condition while the terminal is being crimped onto the wire end. A clamping means is provided in the form of a clamping plate 60 which is on the end of the piston rod 58 which extends from the cylinder 56. The cylinder and piston rod are under the control of the microprocessor which controls the operating cycle for the machine. The nozzle body is coupled by a coupling 64 to the flexible tube 62 which extends in an upstream direction to the feed rolls.

The block 50, through which the rods 48 slidably extend, is supported for limited vertical pivotal movement on a horizontally extending rod 65 which extends between and is supported on the arms 67 of a clevis 66. A cylinder 70 is provided in order to bring about limited horizontal movement of the block 50 to the extent permitted by the spacing of the arms 67 for reasons discussed below.

Figure 8:
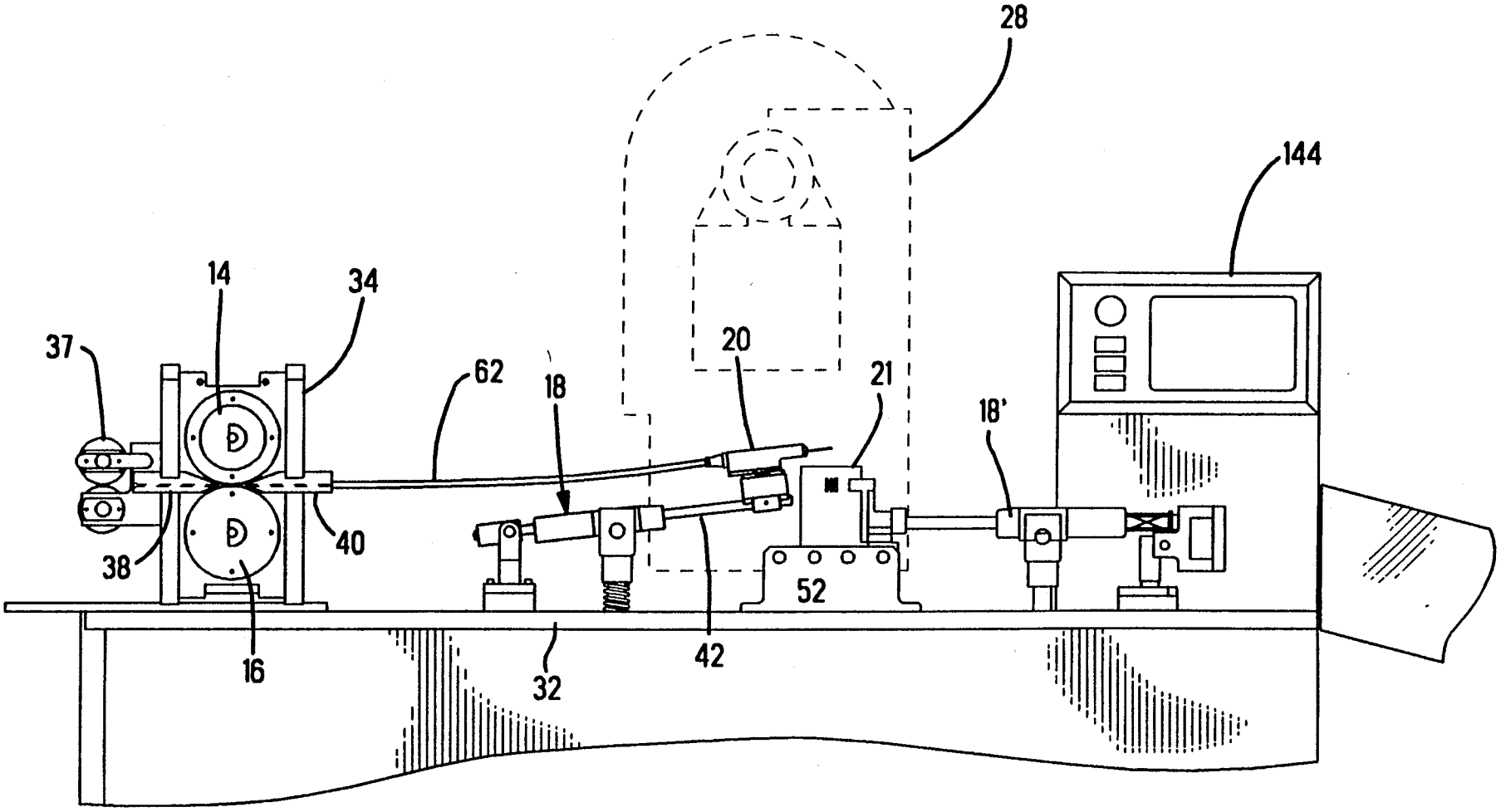
FIG. 8 is a side view looking in the direction of the arrows 8—8 of FIG. 7.
Figure 10:
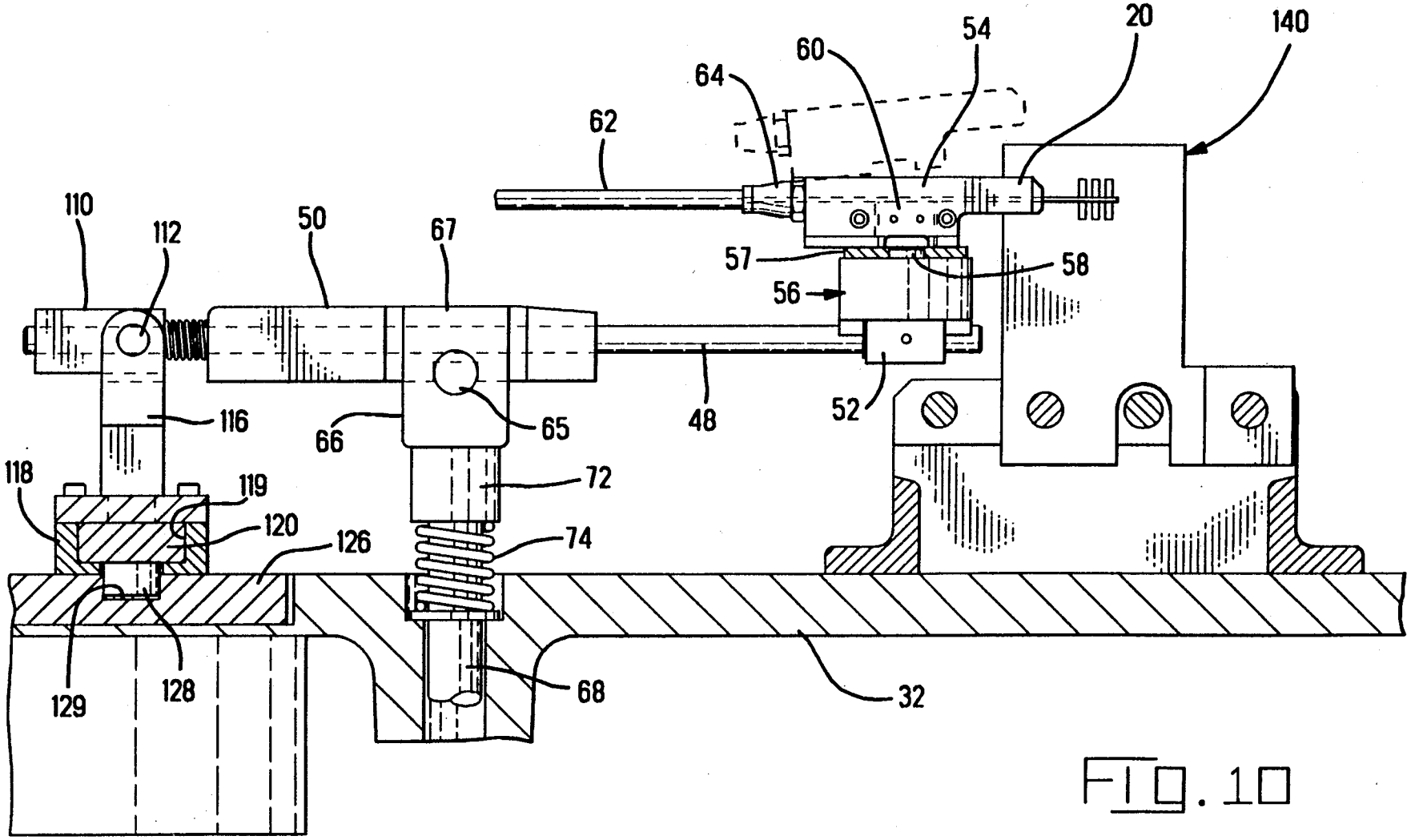
FIG. 10 is a side view of the transferring mechanism looking in the direction of the arrows 10—10 of FIG. 9.

The clevis 66 is supported on the upper end of a vertically extending rod 68 and has a collar 72 on its underside which is engaged by a spring 74 that surrounds the rod 68 and extends into a recess 76 in the plate 32. The spring 74 normally biases the rod 68 and the clevis 66 upwardly so that the lever assembly is inclined upwardly as shown in FIG. 8. The lever assembly is in the orientation of FIG. 8 during shifting of the transferring mechanism from its terminating position to its aligned position but it must be in a horizontal attitude as shown in FIG. 10 for the remainder of the operating cycle. The rod 68 is held in a lowered position against the force of the spring 74 by a mechanism on the underside of the plate 32 which will now be described.

Figure 12:
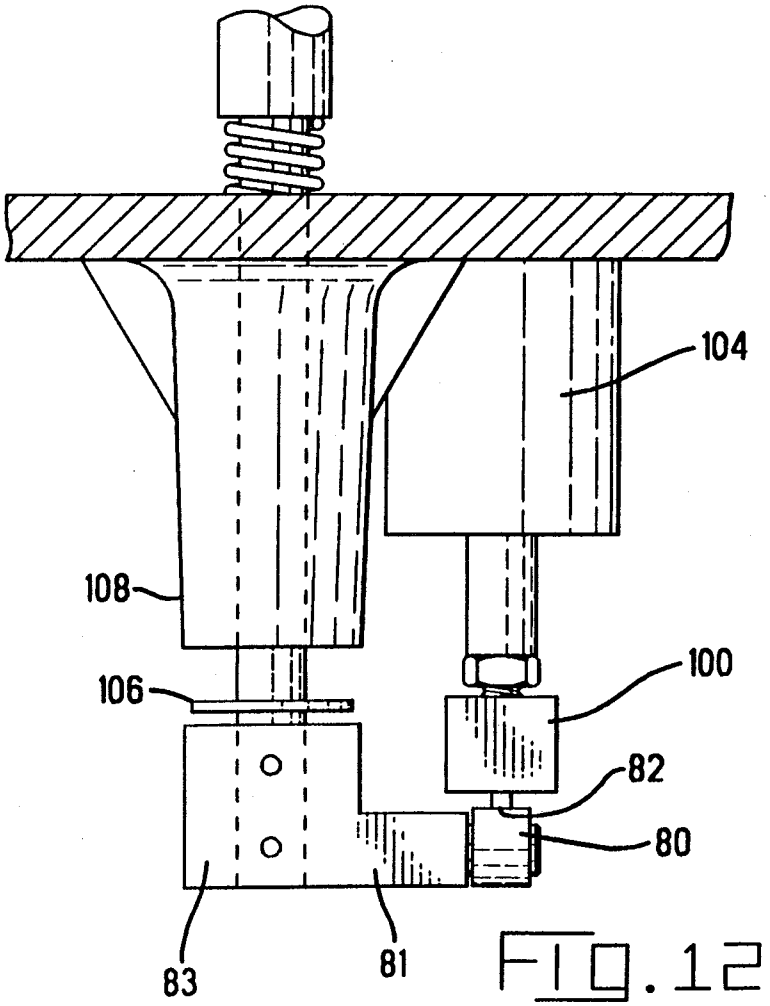
FIG. 12 is an end view of the transfer mechanism of FIG. 11 looking in the direction of the arrows 12—12 of FIG. 11.
Figure 11:
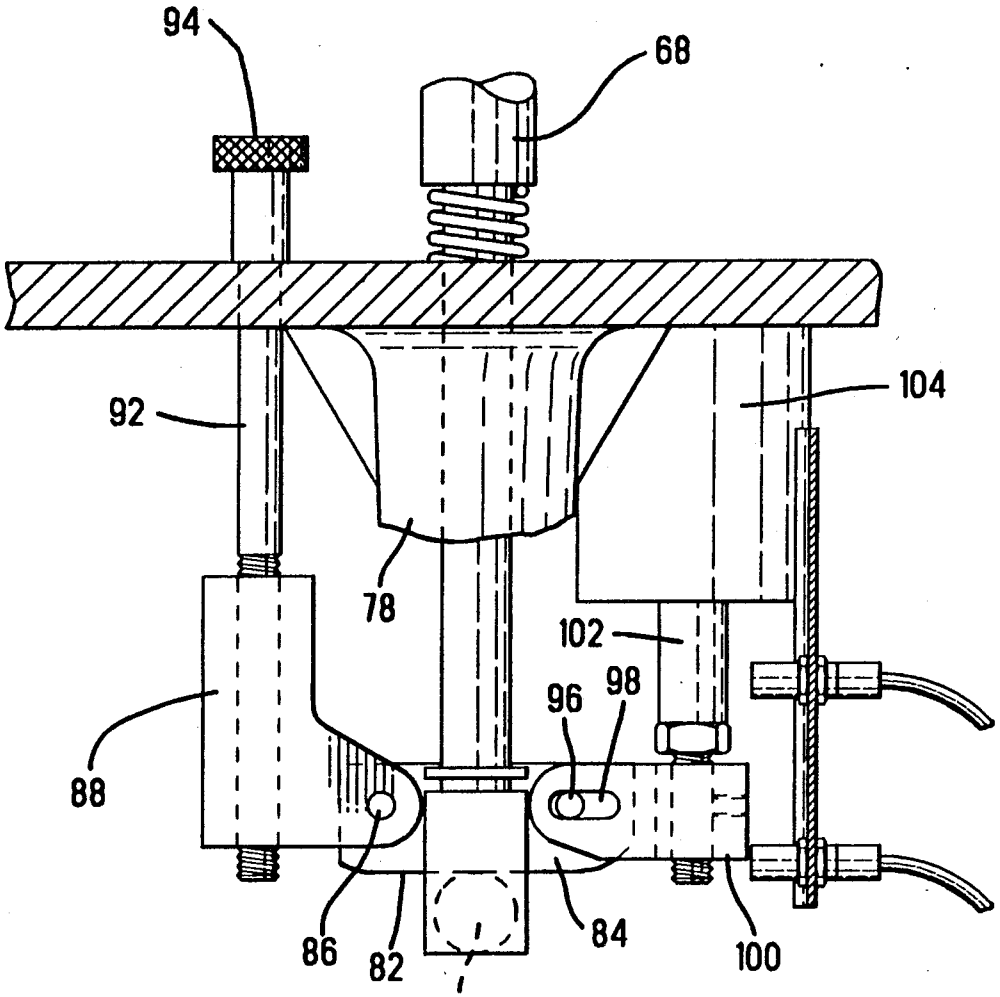
FIG. 11 is a fragmentary view showing the mechanism for controlling the support rod on which the transfer mechanism is mounted.

As shown in FIGS. 11 and 12, the rod 68 extends through a bearing 78 on the underside of the plate 32 and has a sleeve 83 fixed on its lower end. An arm 81 extends from the sleeve 83 and has a cam roller 80 on its end which is engageable with the lower edge 82 of a camming plate 84. This camming plate is pivoted on its left-hand end as viewed in FIG. 11 at 86 to a sleeve 88 which is threaded onto an adjusting rod 92 which extends vertically upwardly through the plate 32 and which has a knob 94 on its end. The sleeve 88 and rod 92 are stationary during normal operation of the machine and are employed only when the height of the transferring mechanism must be adjusted as will be explained below.

The right-hand end, as viewed in FIG. 11, of the plate 84 is received between the arms of a clevis 100 which is secured to the end of a piston rod 102. The plate 84 has a pin 96 extending through its right-hand end which is received within slots 98 in the arms of the clevis 100. The piston rod 102 extends from a cylinder 104 which is mounted on the underside of the plate 32. In FIGS. 11 and 12, the piston rod is shown in its extended position. When the piston rod is in this position, the plate 84 extends horizontally and its lower edge 82 is against the cam roller 80 and functions to hold the rod 68 in its lowered position against the compression of the spring 74. When the piston rod 102 is retracted, that is, when it is moved upwardly from the position shown in FIG. 12, the plate 84 is caused to pivot upwardly so that the rod 68 can be moved upwardly under the influence of the spring 74. Such upward movement of the rod 68 is limited by a stop washer 106 which is secured to the rod above the sleeve 83 and which is engageable with the end 108 of the bearing 78. When the rod 68 is in its raised position, the transfer mechanism is inclined upwardly as shown in FIG. 8. When the piston rod is in its lowered position, the transfer mechanism extends horizontally as shown in FIG. 10.

Figure 9:
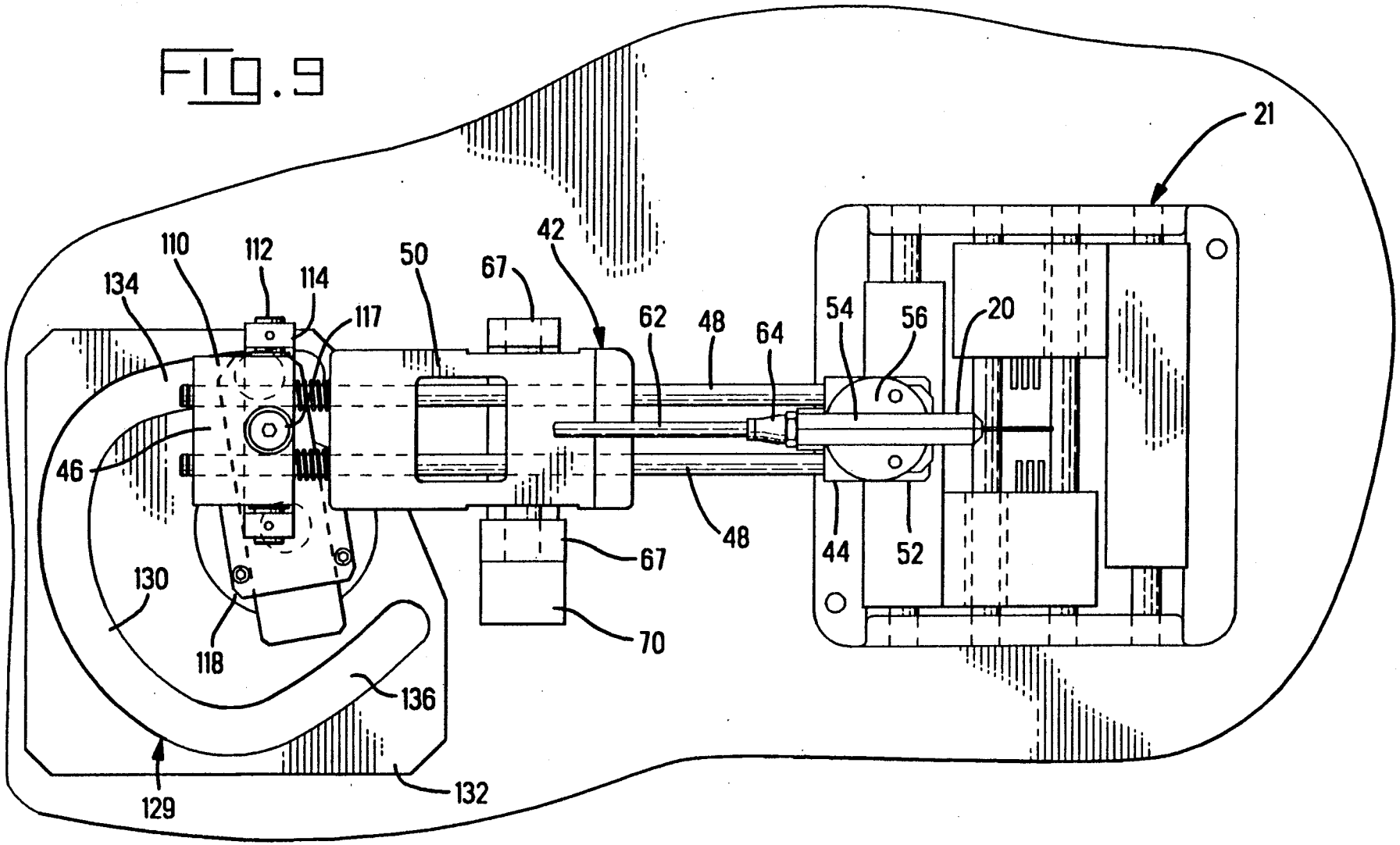
FIG. 9 is a top plan view on an enlarged scale of the upstream transferring mechanism.

The upstream ends of the rods 48 are secured to a block 110, FIG. 9, which is supported for vertical pivotal movement on a horizontally extending pivot pin 112 which in turn extends between the arms 114 of a clevis 116. Springs 51 are provided on the rods 48 between the blocks 50, 110 for the purpose of stabilizing the two blocks.

The clevis 116 is pivotally secured to a slide 120 by means of a vertically extending pivot pin 117 for limited pivotal movement in a horizontal plane. Slide 120 is slidably contained in a recess 119 which extends across a slide housing 118. Housing 118 is keyed or otherwise secured to the output shaft 124 of a rotary actuator 126. Slide 120 has a cam follower 128 thereon which is received in a U-shaped cam track 129 in a camming plate 132 which is supported on the top plate 32. The cam track has straight end portions 134, 136 and a curved intermediate portion 130. A cover 121 is provided on the slide housing to retain the slide 120 in the housing.

During an operating cycle, the actuator 126 causes the cam follower 128 to move from its position shown in FIG. 9 along the cam track past the intermediate portion 130 to the end portion 136 of the cam track. Initially, and while the cam follower is in the relatively straight end portion 134, the entire transfer assembly, including the lever, is moved leftwardly as viewed in FIG. 9 to bring about the wire stripping operation. As the cam follower enters the central intermediate portion 130 of the U-shaped cam slot, the transfer mechanism is swung through an angle of about 45 degrees in an anti-clockwise direction as viewed in FIG. 9 so that the end portion of the wire is aligned with the tooling in the terminal applicator 28. As the cam follower moves into the end portion 136 of the cam slot, the transfer mechanism moves parallel to the axis of the wire and thereby positions the wire properly between the opposed tooling members such as crimping dies and anvils for the crimping operation.

Rotation of the actuator in the reverse direction causes the cam follower to follow the reverse of the course described above and the transfer mechanism is thereby shifted back to its aligned position shown in FIG. 9. During such shifting from the terminating position to the aligned position, the transfer mechanism is tilted upwardly by the rod 68 as generally described above.

The severing blades and the insulation cutting blades are contained in a housing assembly 140 and are moved relatively towards and away from each other by an actuator such as a pneumatic actuator. The movement of the blades is again controlled by the microprocessor and the construction and operation is otherwise conventional.

The cylinder 70 on the clevis arms 67 can be used to move the transfer lever a very slight distance laterally of its length and to the extent permitted by the spacing of the clevis arm 67. This motion may be employed under certain circumstances where it is difficult to remove the crimped terminal from the terminating machine without some lateral movement of the terminal. This function of the machine is not related to the instant invention and need not be described further.

The adjusting rod 92 may be rotated on occasion when the machine is being set up for a particular set of operating conditions. This rod raises and lowers the transfer mechanism and may be used, for example, when a particular terminal being applied requires that the transfer mechanism be raised or lowered by a slight amount from its normal position. This adjusting mechanism is not part of the instant invention and is, as noted above, in a fixed position and static during normal operation of the machine.

While it is preferable to mount the blades in the cutting and stripping assembly horizontally and feed the wire over and above the blades, it is possible to incorporate the invention into lead making machines which have vertically extending blades as in the machine shown in U.S. Pat. No. 3,019,679. It is necessary, in the case of vertically mounted blades, to provide clearance for the wire extending from the transfer mechanism (which was fed during shifting) so that the wire will extend along the feed path when the transfer mechanism arrives at its aligned position. Clearance can be provided, for example, by mounting the vertically extending cutting and stripping blades in a C-shaped frame or housing having its open side on the same side of the feed path as the side on which the terminal applicator is located.

Figure 13:
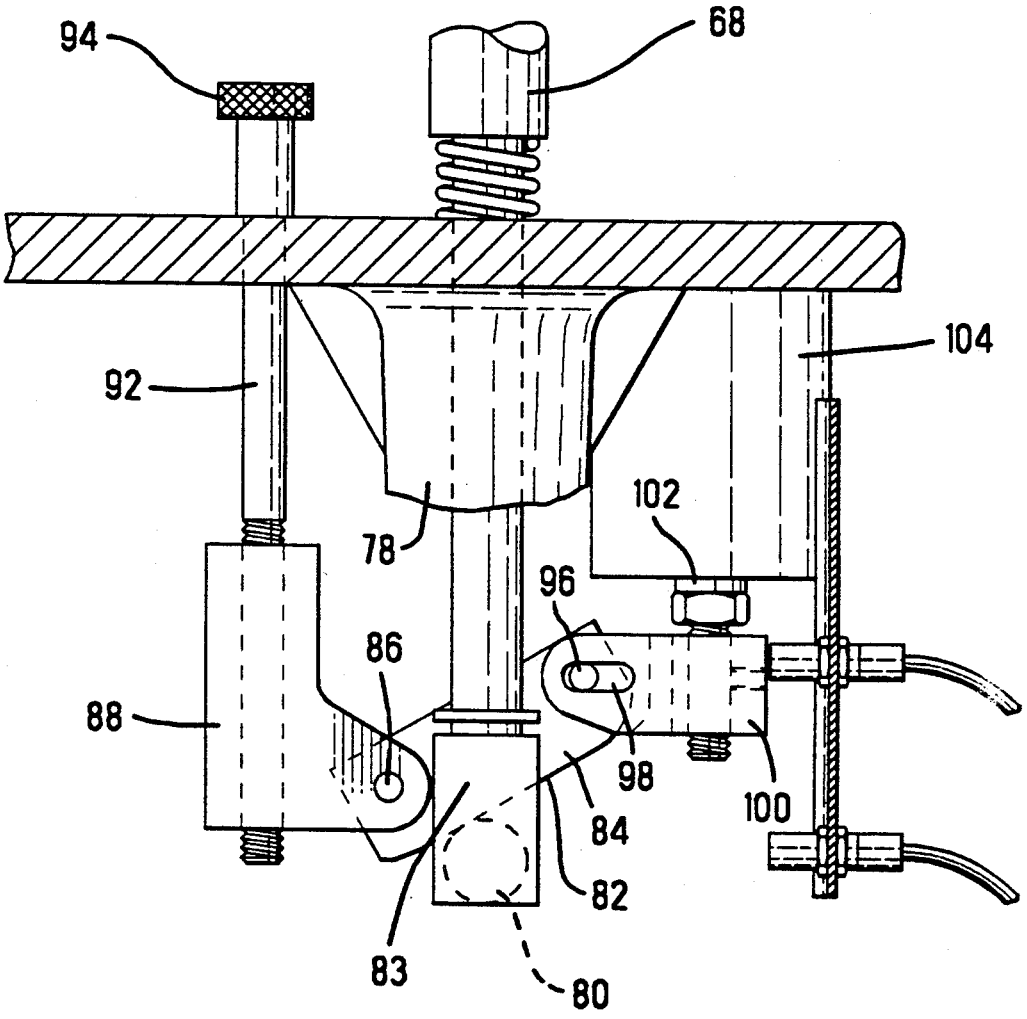
FIG. 13 is a view similar to FIG. 11 but showing the positions of the parts when the actuator is in its raised position.
Figure 14:
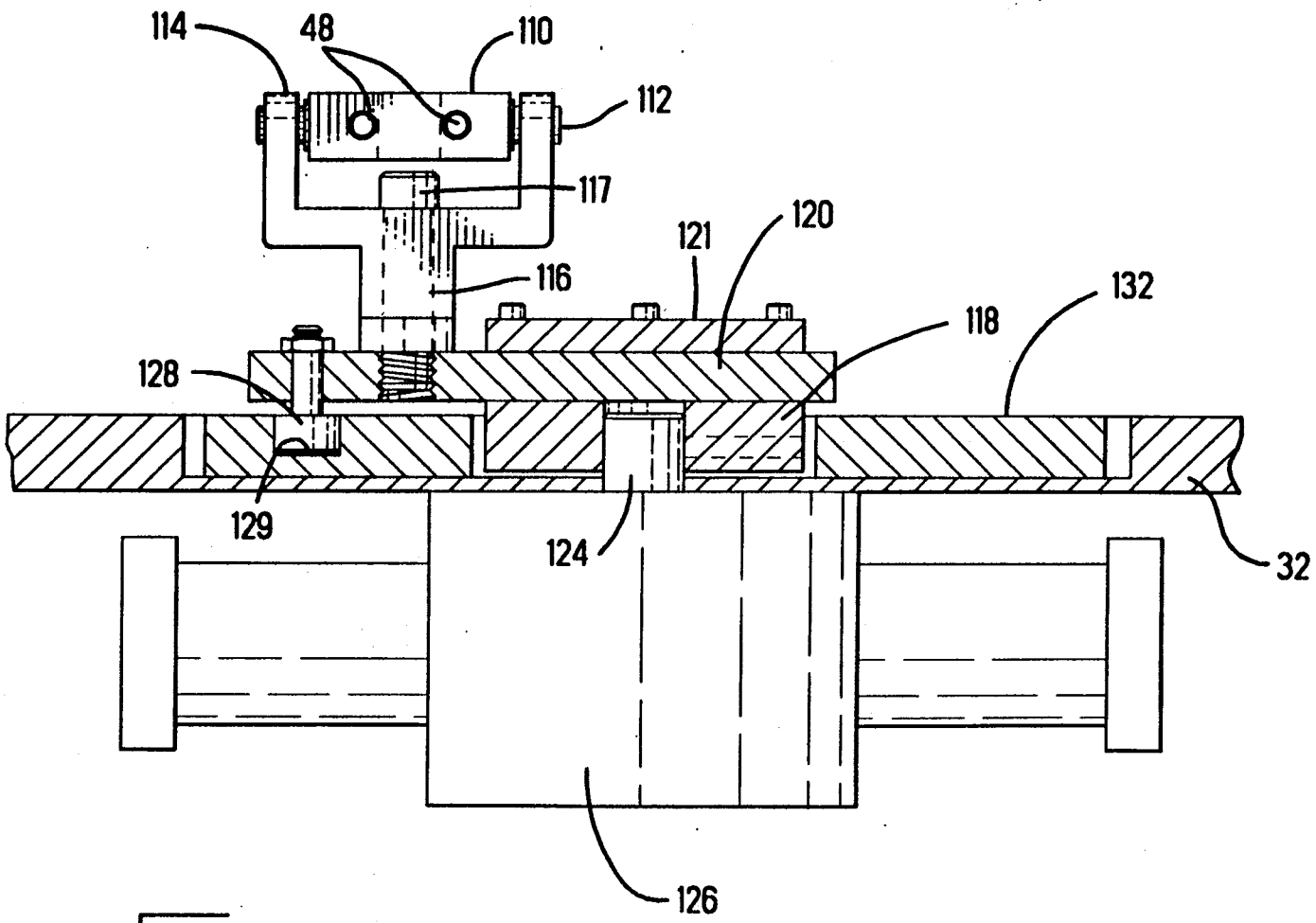
FIG. 14 is a fragmentary view showing the rotary actuator which shifts the position of the transfer mechanism.

A micro-processor 144, FIG. 8, is preferred for controlling the operations of the machine such as wire feeding, closing the cutting blades, etc. It is preferable to program the micro-processor to operate the machine with sequential logic so that none of the subassemblies of the machine are operated to carry out a particular step until the preceding step in the cycle has been carried out. For example, the micro-processor is programmed to operate the terminal applicator 28 only after the transferring means 18 has been shifted to its terminating position. This type of controlling system requires sensors on the machine subassemblies which sense the positions of the parts and send signals to the micro-processor that a particular step in the cycle has been carried out. Upon receipt of the signal, the microprocessor will send a signal to the subassembly of the machine which carries out the next step. Two such sensors 146 are shown in FIGS. 11 and 13 which sense the positions of the piston rod 102. In the above-described embodiment of the invention, the microprocessor sends the signal to the wire feeding system 13 to commence feeding wire after it has received a signal from the sensors for the wire transferring mechanism 18 that the shifting step has begun.

Figure 6:
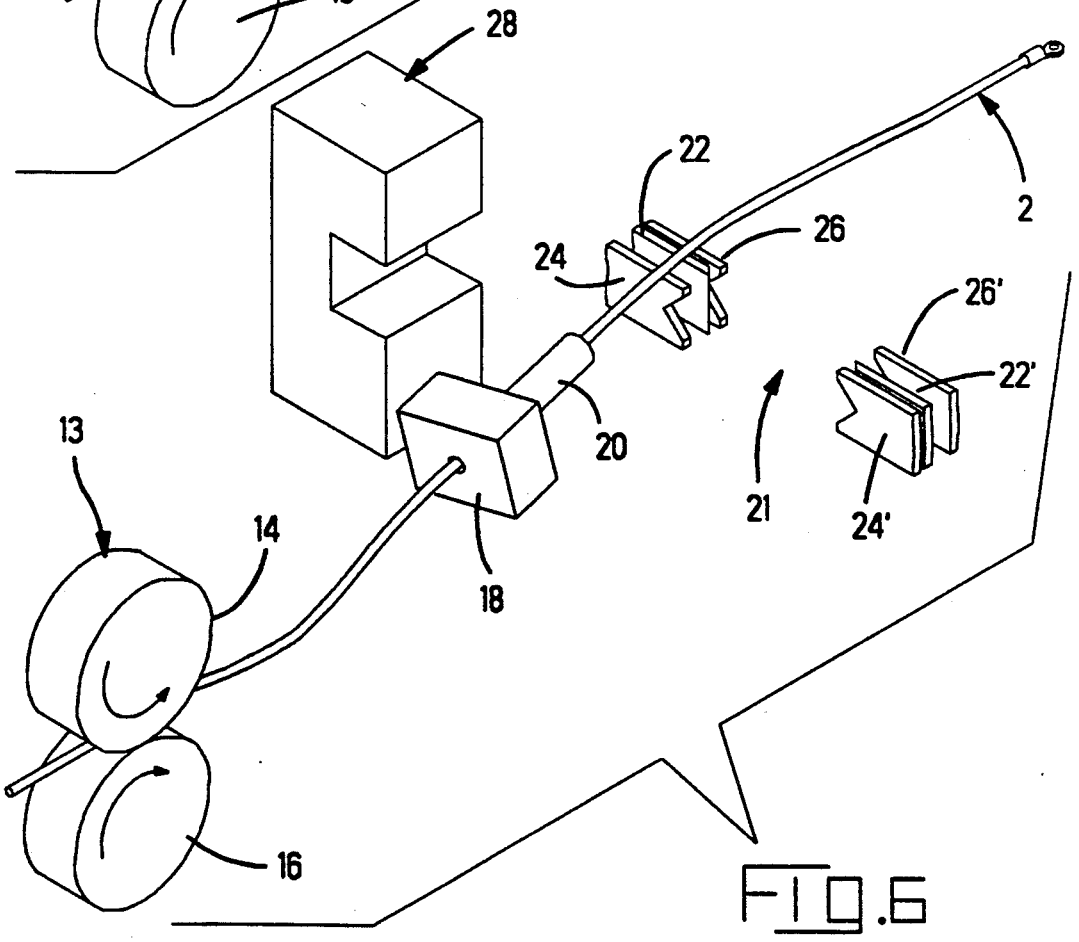

The amount by which the feeding interval is lengthened will depend upon the speed at which the machine is being operated and will be significant in all cases. If the machine is being operated at a speed (or rate) of one cycle per second, the wire feeding interval can include about 100 milliseconds which overlaps the interval during which the transferring mechanism is being shifted from its terminating position (FIG. 4) to its aligned position (FIG. 6). If a short lead is being produced, say 6", it may be possible to complete the feeding step prior to arrival of the transferring mechanism at its aligned position.

Figure 7:
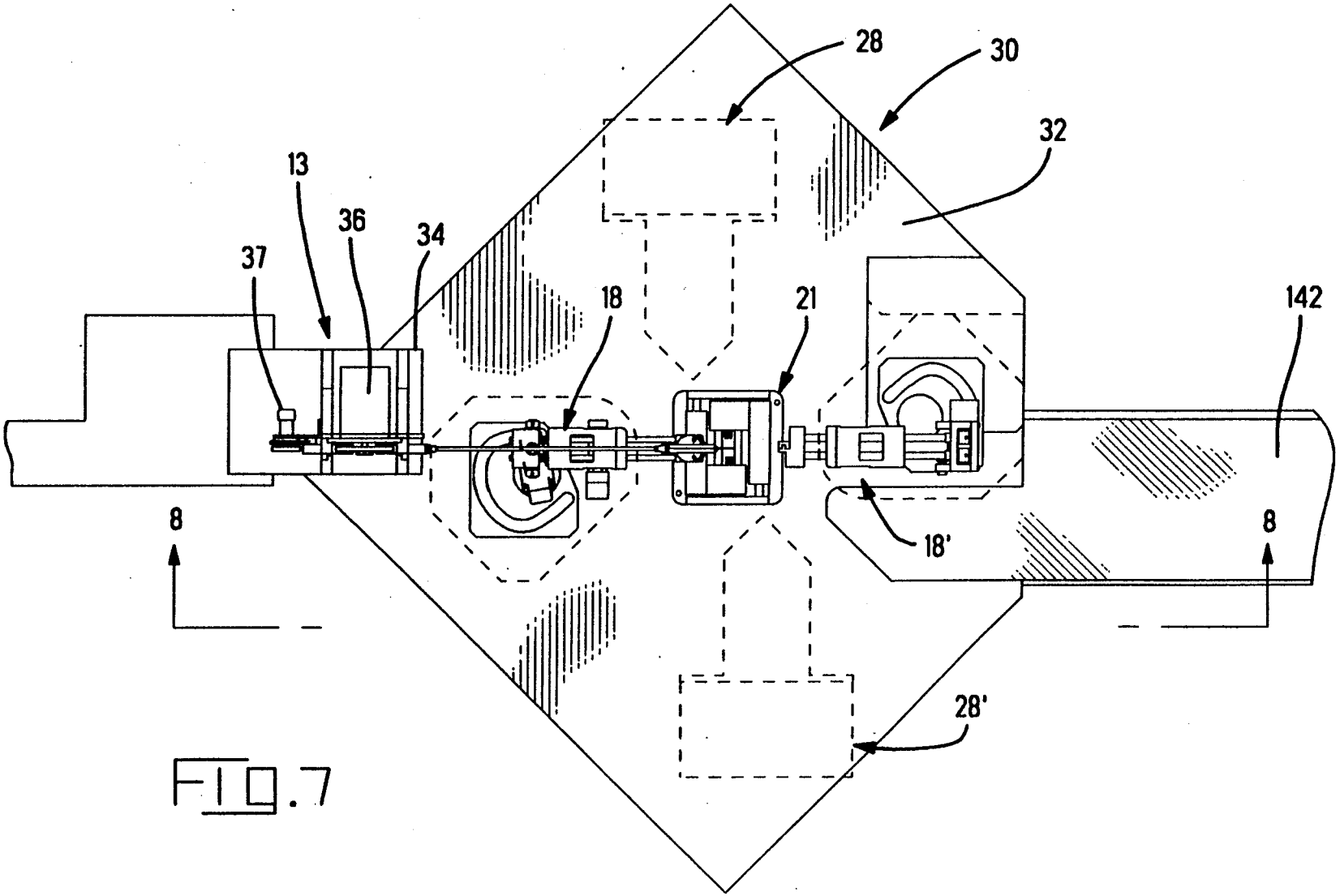
FIG. 7 is a top plan view of a machine for practicing the invention.

FIG. 7 shows a downstream wire transferring mechanism 18' and a downstream terminal applicator 28' for applying terminals to the trailing end of the lead 2 if desired. These mechanisms or parts of the machine are not part of the present invention and need not be described in detail beyond pointing out that the transfer mechanism 18 is shifted by a camming system similar to that used for the transfer mechanism 18. A conveyor 142 may be provided as shown for carrying the finished leads 2 from the machine.

The complete operating cycle for the machine is as follows. At the beginning of the cycle, the wire will have been fed from the spool or barrel to the position shown in FIG. 2; that is, the wire will extend past the stripping and wire cutting station as shown in FIG. 10 and past the downstream transfer mechanism 18'. The wire severing and insulation cutting mechanism is first actuated to cut the wire and to cut the insulation circumferentially adjacent to the cut end. The transfer mechanism will be in its horizontal attitude shown in FIG. 10 during this portion of the cycle. After cutting the insulation, the actuator for the cam mechanism shown in FIG. 9 is engaged to cause the cam follower to move along the U-shaped cam track 130, 134, 136. When the cam follower moves in the straight end section 134 of the cam track, the transfer lever is pulled leftwardly from the position shown in FIG. 9 thereby to pull the stripped end of the wire from the sections of insulation which remain between the closed insulation cutting blades and which are removed by compressed air or any other suitable means. As the cam follower 128 moves through the central section 130 of the cam track, the lever assembly is swung in a counterclockwise direction as viewed in FIG. 9 to the dotted line position so that the stripped end is in alignment with the crimping tooling or other application tooling in the terminal applicator 28. The cam follower then moves into the end section 136 of the cam track so that the stripped end of the wire is advanced along with the lever assembly and positioned in alignment with the crimping tooling. The terminal is thereafter crimped onto the wire end and the actuator for the plate 120 is again actuated to move the cam from the end 136 of the cam track to the end 134. During this interval, the lever assembly is swung in a clockwise direction back to the position shown in FIG. 9 and moves axially in the guideblock 50. Also during this interval, the piston rod 102, FIG. 12, is moved upwardly thereby to rotate the plate 84 upwardly. As a result of this upward pivotal movement of the plate 84, the rod 68 is moved upwardly under the influence of the spring 74 until the stop member 106 is against the end 108 of the bearing 78. The wire feeding rolls are started during arcuate movement of the lever assembly so that the wire, having a terminal on its end, is fed during the return movement of the lever assembly and is fed upwardly along a trajectory which extends over and above the wire severing and insulation cutting blades. At the conclusion of the shifting operation, that is, when the lever assembly arrives in the position shown in FIG. 9, it will still be inclined upwardly as shown in FIG. 8. The piston rod 102 is then moved downwardly by the piston contained in the cylinder 104 so that the camming plate 84 swings downwardly and moves the cam follower 80 downwardly. The rod 68 is thus lowered and is brought into the position shown in FIG. 10.

It will be apparent from the foregoing description that two significant advantages are achieved in the practice of the invention. By virtue of the fact that the transfer mechanism is tilted upwardly while the wire is being fed past the wire severing and insulation cutting blades, there is no possibility that the wire or the terminal on the end of the wire will move against the wire severing and insulation cutting blades requiring that the machine be stopped. The wire moves over these blades and completely avoids contact with them. The second advantage is achieved by virtue of the fact that the wire feeding step is commenced while the transfer mechanism is being shifted from its terminating position to its aligned position. This feature of the machine adds a significant interval to the time available for feeding wire and thereby permits the manufacture of longer leads than would otherwise by the case and/or permits the machine to be operated at a higher rate so that more leads can be produced in a given time period.

What is claimed is:

1. A lead making machine comprising wire feeding means for intermittently feeding wire, during a feeding interval, from an endless source along a horizontal wire feed path which extends through a wire transferring means and thence past a pair of open wire severing blades, the machine having a terminal applicator located beside the feed path proximate to the wire transferring means, the wire transferring means being shiftable between an aligned position and a terminating position, the transferring means extending parallel to the feed path when in its aligned position and being directed towards the terminal applicator when in its terminating position, the wire transferring means being in its aligned position at the beginning of an operating cycle with the leading end of the wire extending from the transferring means whereby upon shifting of the transferring means to its terminating position, a terminal can be attached to the leading end of the wire, and upon subsequent shifting of the transferring means to its aligned position, the wire can be fed during the feeding interval past the severing blades and along the feed path, and upon cutting the fed wire at the end of the feeding interval, an electrical lead is produced having a terminal on its leading end, the machine being characterized in that:

the wire feeding means commences to feed wire while the transferring means is being shifted from its terminating position to its aligned position so that the wire being fed extends beyond the severing blades when the transferring means arrives at its aligned position, clearance is provided in the vicinity of the severing blades for the wire so that the wire being fed does not encounter the severing blades when the transferring means moves into its aligned position, and control means are provided for controlling the feeding means, the transferring means, the terminal applicator, and the severing blades, the control means being effective to cause the feeding means to commence feeding wire while the transferring means is being shifted from its terminating position to its aligned position.

2. A machine as set forth in claim 1 characterized in that the severing blades extend horizontally and the wire is fed over, and above, the severing blades.

3. A lead making machine comprising wire feeding means for intermittently feeding wire, during a feeding interval, from an endless source along a horizontal wire feed path which extends through a wire transferring means and thence past a pair of open wire severing blades, the machine having a terminal applicator located beside the feed path proximate to the wire transferring means, the wire transferring means being shiftable between an aligned position and a terminating position, the transferring means extending parallel to the feed path when in its aligned position and being directed towards the terminal applicator when in its terminating position, the wire transferring means being in its aligned position at the beginning of an operating cycle with the leading end of the wire extending from the transferring means whereby upon shifting of the transferring means to its terminating position, a terminal can be attached to the leading end of the wire, and upon subsequent shifting of the transferring means to its aligned position, the wire can be fed, during the feeding interval past the severing blades and along the feed path, and upon cutting the fed wire at the end of the feeding interval, an electrical lead is produced having a terminal on its leading end, the machine being characterized in that:

the wire severing blades extend horizontally and are normally in spaced apart open positions, the blades being movable horizontally relatively towards each other to a closed position thereby to sever a wire located between the blades, and means are provided for elevating the transferring means during the feeding interval, and the wire feeding means commences to feed wire during shifting of the transferring means to its aligned position and while the transferring means is elevated whereby, the leading end of the wire having a terminal thereon is fed over and above the severing blades.

4. A machine as set forth in claim 3 characterized in that the wire transferring means is shifted from its terminating position to its aligned position along an upwardly inclined path.

5. A machine as set forth in claim 4 characterized in that a pair of opposed normally open insulation cutting blades are provided upstream, relative to the direction of wire feed, from the severing blades and adjacent to the severing blades, the insulating cutting blades extending horizontally and being movable horizontally relatively towards each other in synchronism with closing of the severing blades, wire clamping means are provided on the transferring means, and means are provided for moving the transferring means along the wire feed path in an upstream direction after closing of the severing blades and closing of the insulating cutting blades whereby insulation of the leading end of the wire is cut when a wire is severed and insulation is stripped from the end of the wire prior to shifting the transferring means to its terminating position.

6. A machine as set forth in claim 4 characterized in that the wire transferring means comprises a lever assembly having an upstream end, which is proximate to the wire feeding means, and a downstream end, which is proximate to the severing blades, the wire feed path extending through a passageway in the lever assembly, the passageway having an outlet at the downstream end, the lever assembly being pivoted intermediate its ends on a vertical axis for pivoting movement in a horizontal plane in order to shift the transferring means between its aligned position and its terminating position.

7. A machine as set forth in claim 6 characterized in that the lever assembly is pivoted on a horizontal axis at its upstream end for pivoting movement in vertical directions in order to permit elevation and lowering of the means.

8. A machine as set forth in claim 7 characterized in that the lever assembly is supported intermediate its ends on a vertically extending support rod which forms the vertical axis, and rod controlling means are provided for raising and lowering the rod thereby to raise and lower the transferring means.

9. A machine as set forth in claim 8 characterized in that the rod controlling means comprises a spring which biases the rod to its raised position and camming means for lowering the rod and holding the rod in its lowered position with accompanying compression of the spring.

10. A machine as set forth in claim 9 characterized in that the camming means comprises a collar mounted on the rod, a cam follower on the collar, and a camming plate which is engageable with the cam follower.

11. A machine as set forth in claim 10 characterized in that the camming plate is pivotally mounted for arcuate movement in a vertical plane and has a downwardly directed camming surface which is engaged by the cam follower, and means are provided for pivoting the camming plate downwardly against the cam follower thereby to lower the rod and lower the transferring means.

12. A machine as set forth in either of claims 7 or 11 characterized in that transfer camming means are provided on the upstream end of the lever assembly for moving the upstream end along an arcuate path thereby to pivot the lever assembly about the vertical axis thereby to shift the transferring means between its aligned and terminating positions.

13. A machine as set forth in claim 12 characterized in the transfer camming means comprises a generally U-shaped cam track which is in a horizontal plane, and a transfer cam follower which is on the upstream end of the lever assembly and which is in the cam track.

14. A machine as set forth in claim 13 characterized in that an actuator is provided on the upstream end of the lever assembly for moving the transfer cam follower in the U-shaped cam track.

15. In the method of manufacturing electrical leads in which, at the start of a manufacturing cycle, wire which was fed during the preceding cycle extends from an endless source along a horizontal feed path which extends through a wire transferring means, which is in an aligned position on the feed path, thence past a pair of open wire severing blades, the method comprising the steps of closing the severing blades thereby to cut the wire so that the leading end of the wire extends from the transferring means, shifting the transferring means to a terminating position, in which it extends laterally of the feed path, thereby to present the cut end of the wire to a terminal applicator which is located beside the feed path, shifting the transferring means back to its aligned position, opening the severing blades, and then feeding wire, during a wire feeding interval, from the endless source for the next operating cycle, the improvement comprising the steps of:

elevating the transferring means during shifting of the transferring means back to its aligned position and starting to feed the wire during shifting of the transferring means so that the wire is fed along a trajectory which extends over, and above, the severing blades, and lowering the transferring means prior to closing the severing blades so that the fed wire is between the open severing blades whereby, the possibility of interference with the feeding step by the severing blades is eliminated.

16. The method set forth in claim 15 characterized in that the transferring means is lowered after it has been shifted from its terminating position to its aligned position.

* * * * *

UNITED STATES PATENT OFFICE
CERTIFICATE OF CORRECTION

Patent No. 5,025,549 Dated June 25, 1991

Inventor(s) Craig W. Hornung and Alden O. Long

It is certified that error appears in the above-identified patent and that said Letters Patent is hereby corrected as shown below:

In claim 1, column 9, line 61, after "fed" insert --,--; and after "interval" insert --,--.

In claim 3, column 10, line 37, after "interval" insert --,--.

In claim 7, column 11, line 22, after "the" insert --transferring--.

In claim 13, column 12, line 5, after second occurrence of "in" insert --that--.

Signed and Sealed this

Eighth Day of December, 1992

*Attest:*

DOUGLAS B. COMER

*Attesting Officer*

*Acting Commissioner of Patents and Trademarks*